United States Patent [19]

Sherikar

[11] Patent Number: 4,966,523

[45] Date of Patent: Oct. 30, 1990

[54] TWO-ROW PIPE DIFFUSERS WITH BOUNDARY LAYER CONTROL

[75] Inventor: Sanjay V. Sherikar, Tempe, Ariz.

[73] Assignee: Tiernay Turbines, Incorporated, Phoenix, Ariz.

[21] Appl. No.: 385,898

[22] Filed: Jul. 27, 1989

[51] Int. Cl.[5] ..... F04D 29/44

[52] U.S. Cl. ..... 415/208.4; 415/207; 415/211.2

[58] Field of Search ..... 415/206, 207, 208.1, 415/208.2, 208.3, 208.4, 211.1, 211.2, 224.5

[56] References Cited

U.S. PATENT DOCUMENTS

| | | | |
|---|---|---|---|
| 2,836,347 | 5/1958 | Barr et al. | 415/186 |
| 3,719,430 | 3/1973 | Blair et al. | 415/207 |
| 3,743,436 | 7/1973 | O'Connor | 415/207 |
| 4,022,541 | 5/1977 | Perrigo et al. | 415/207 |
| 4,027,997 | 6/1977 | Bryans | 415/207 |
| 4,099,891 | 7/1978 | Campbell | 415/207 |
| 4,234,290 | 11/1980 | Lobach et al. | 415/207 |
| 4,302,150 | 11/1981 | Wieland | 415/207 |

FOREIGN PATENT DOCUMENTS

| | | | |
|---|---|---|---|
| 948886 | 2/1964 | United Kingdom | 415/186 |

*Primary Examiner*—John T. Kwon
*Attorney, Agent, or Firm*—Louise S. Heim

[57] ABSTRACT

A diffuser for a radial flow compressor includes a pair of coaxial rings, the second of which closely surrounds the first. A set of intersecting flow passages extends through the first ring, and another aligned set of flow passages extends through the second ring. In a first embodiment of the invention, a circumferential groove is formed between the two rings, thus allowing low momentum fluid to migrate from the pressure side of one passage to the suction side of a neighboring passage and to prevent boundary layer build-up. In a second embodiment of the invention, the passages are arranged in a double cone configuration which allows higher diffusion levels than are attainable in a straight cone diffuser of equal length.

4 Claims, 3 Drawing Sheets

10
12
14
16
18
20
22
24
26
28
32
34
36
38
A
B
3
α

TWO-ROW PIPE DIFFUSERS WITH BOUNDARY LAYER CONTROL

BACKGROUND OF THE INVENTION

1. Field of the Invention

This invention relates to diffusers for use with radial centrifugal compressors.

More particularly, this invention relates to two-row pipe diffusers.

In a further and more specific aspect, the instant invention concerns configurations for controlling the amount of boundary layer build-up and increasing the rate of diffusion in a pipe diffuser.

2. Description of the Prior Art

Gas turbine engines and various other types of turbomachinery commonly employ centrifugal compressors in which a rotating impeller is arranged to add kinetic energy by accelerating the gas flow. A diffuser is located downstream of the impeller for reducing the velocity of the outflowing gas and thus converting the kinetic energy into static pressure. The overall performance of the compressor, and therefore of the engine itself, is influenced greatly by the effectiveness with which the diffuser makes this kinetic-energy-to-pressure conversion. Accordingly, it is very important when designing a diffuser to select a configuration in which frictional and other types of losses which reduce the static pressure recovery of the diffuser are minimized.

The simplest type of diffuser is the vaneless diffuser, which consists merely of an open annular area surrounding the periphery of the compressor impeller. In this configuration, the gas flows in a natural spiral path from the tip of the impeller blade to the outer circumference of the diffuser. Because the natural flow path is rather long and circuitous, losses due to friction and the like in a vaneless diffuser tend to be great, and static pressure recovery is poor.

A second type of diffuser, which remedies many of the problems in the veneless diffuser, is the vaned or bladed diffuser. In vaned diffusers, a plurality of passages are formed between rows or islands of vanes. The passages are generally rectangular in cross-section. These passages guide the fluid from the tip of the impeller blade to the outer circumference of the diffuser by a shorter path than is permitted by the vaneless arrangement, and thus reduce the losses due to friction.

Nonetheless, vaned or bladed diffusers suffer from a number of shortcomings. One problem is that boundary layers tend to build up on the walls along the corners of the rectangular flow passages. This tends to promote detachment of the boundary layer and decreases the effectiveness of static pressure recovery. Another problem is that vaned diffusers are difficult to manufacture. Great care must be taken to provide each of the vanes with a profiled leading edge for preventing or reducing shock waves at the inlet of the diffuser. The leading edge must be very precisely machined, and the vanes carefully assembled relative to one another and to the impeller in order to avoid losses and to obtain geometric balance. As a result, production costs are high.

In response to the aforementioned problems, a third type of diffuser, known as the pipe, or channel, diffuser was developed. The pipe diffuser comprises a solid annular member surrounding the impeller and having a plurality of passageways extending therethrough.

Perhaps the best-known example of a pipe diffuser is that shown in U.S. Pat. No. 3,333,762 to Vrana. Each of the passageways of Vrana has a curvilinear cross-section and extends through the annular member in such a manner as to be tangent to a common circle substantially equal in diameter to the periphery of the impeller. Each passageway is disposed so that it intersects with the next adjacent passageway near the inner circumference of the annular member. The spacing and geometry of the passageways are such that a plurality of overlapping elliptical openings surround the periphery of the impeller blades, thus forming an undulating, or "scalloped" leading edge which prevents the occurrence of shock waves.

The pipe diffuser of Vrana and other diffusers of similar construction are generally more effective at producing high pressure rises than are the conventional vaned and vaneless diffusers discussed above. The performance of this type of pipe diffuser is good even when the Mach number of the gas discharged from the impeller is high. However, when the mass flow rate drops below design point, the passageways tend to become blocked due to boundary layer build-up, thus leading to diffuser stall and surge. These problems can become especially severe at low inlet pressure and low inlet temperature operating conditions in the compressor of a turbine engine.

It would be highly advantageous, therefore, to remedy the foregoing and other deficiencies inherent in the prior art.

Accordingly, it is an object of the present invention to provide means for controlling boundary layer growth in a pipe diffuser.

Another object of the invention is the provision of a pipe diffuser with an improved rate of diffusion.

And another object of the invention is to provide a pipe diffuser capable of optimum static pressure recovery at design point.

Still another object of the invention is the provision of a pipe diffuser capable of high performance over a wide flow range.

Yet another object of the invention is to provide a pipe diffuser with improved stall characteristics.

Yet still another object of the invention is the provision of a diffuser configuration which minimizes losses due to friction and the like.

And a further object of the invention is to provide a diffuser with optimum leading edge geometry, for reducing entry shock during subsonic, transonic, and supersonic flow.

And still a further object of the invention is the provision of a diffuser, according to the foregoing, which can be simply, economically, and accurately manufactured.

SUMMARY OF THE INVENTION

Briefly, to achieve the desired objects of the instant invention in accordance with the preferred embodiments thereof, a centrifugal compressor is provided with a two-row pipe diffuser configured for boundary-layer control. More specifically, the diffuser comprises a first annular member having an inner circumference closely surrounding the compressor impeller and a second annular member having an inner circumference closely surrounding the first annular member. A first set of radially extending flow passages is formed in the first annular member, and a second set of radially extending passages is formed in the second annular member. The cross-sectional area of each passage increases at a predetermined rate, from a minimum at the inlet, near the impeller, to a maximum at the outlet, at the outer circumference of the corresponding annular member. The flow passages in the first set intersect one another near the inner circumference of the first member, thus forming a scalloped leading edge. Each of the flow passages in the second set is aligned with one of the flow passages in the first set, thus forming a continuous duct through the compressor.

In a first embodiment of the invention, a circumferentially extending groove is formed between the first and second annular members. The groove intersects each of the passages of the diffuser, thus providing a path from the pressure side of each passage to the suction side of the adjacent passage. This allows much of the boundary layer in each passage, which ordinarily accumulates on the pressure side, to be sucked into the neighboring passage. As a result, the amount of blockage due to boundary layer build-up is reduced. In addition, the low momentum fluid in each of the boundary layers is accelerated as it migrates from the high pressure side of one passage to the low pressure side of the adjacent passage. This acceleration tends to re-energize the boundary layer, representing a fresh start for the diffusion process. As a result, overall diffusion levels are higher, stall characteristics are improved, and the operating range of the diffuser is expanded.

In a second embodiment of the invention, which may or may not include the circumferential groove of the first embodiment, the rate at which the cross-sectional area of the flow passages in the second annular member increases is less than the corresponding rate in the first annular member. This configuration approximates the performance of the well-known "temple-bell" shaped, or optimum, diffuser, while simplifying the geometry and reducing sensitivity to inlet flow conditions.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which.

DETAILED DESCRIPTION OF THE PREFERRED EMBODIMENT

Figure 1:
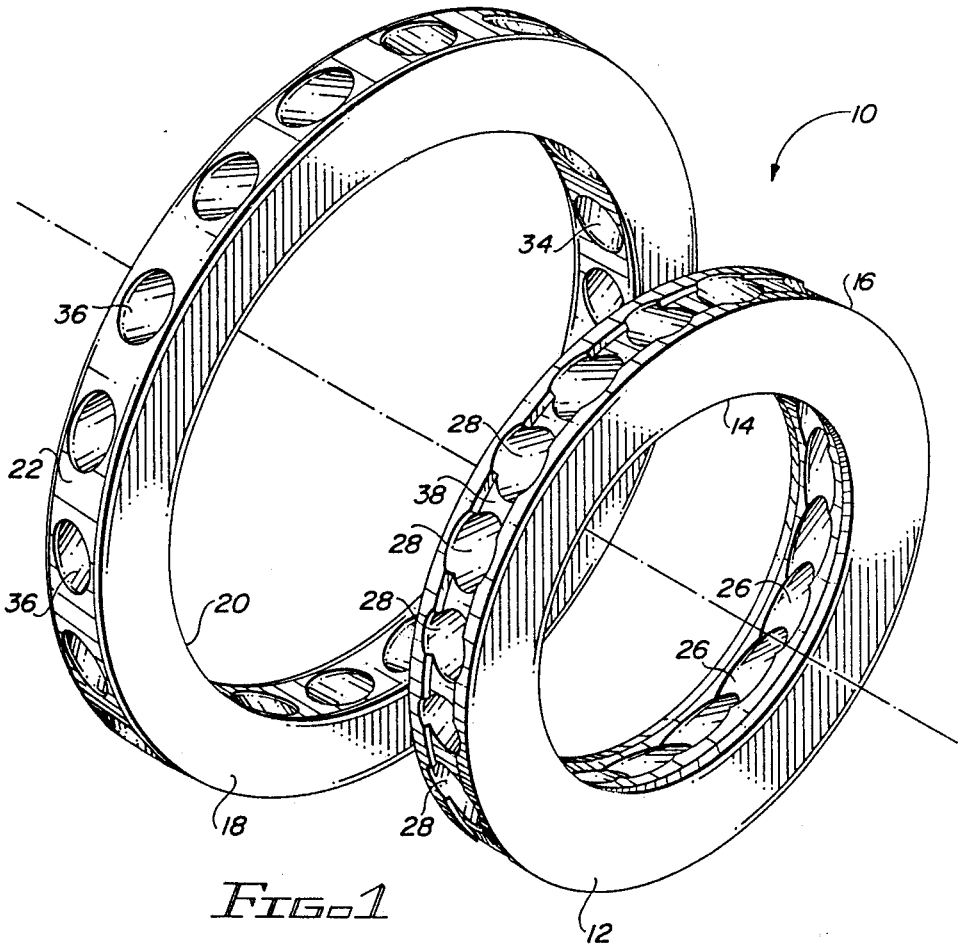
FIG. 1 is an exploded perspective view showing a diffuser according to the present invention.

Turning now to the drawings in which like reference characters indicate corresponding elements throughout the several views, attention is first directed to FIG. 1, which shows the diffuser of the present invention, indicated in its entirety by the numeral 10. The diffuser 10 comprises a first annular member 12, having an inner circumference 14 for closely surrounding the impeller of a centrifugal compressor (not shown) and an outer circumference 16, and a second annular member 18, having an inner circumference 20 for closely surrounding the first annular member 12 and an outer circumference 22.

Figure 3:
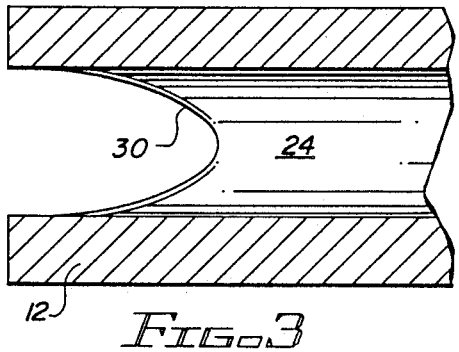
FIG. 3 is a sectional view taken through line 3—3 of FIG. 2.
Figure 2:
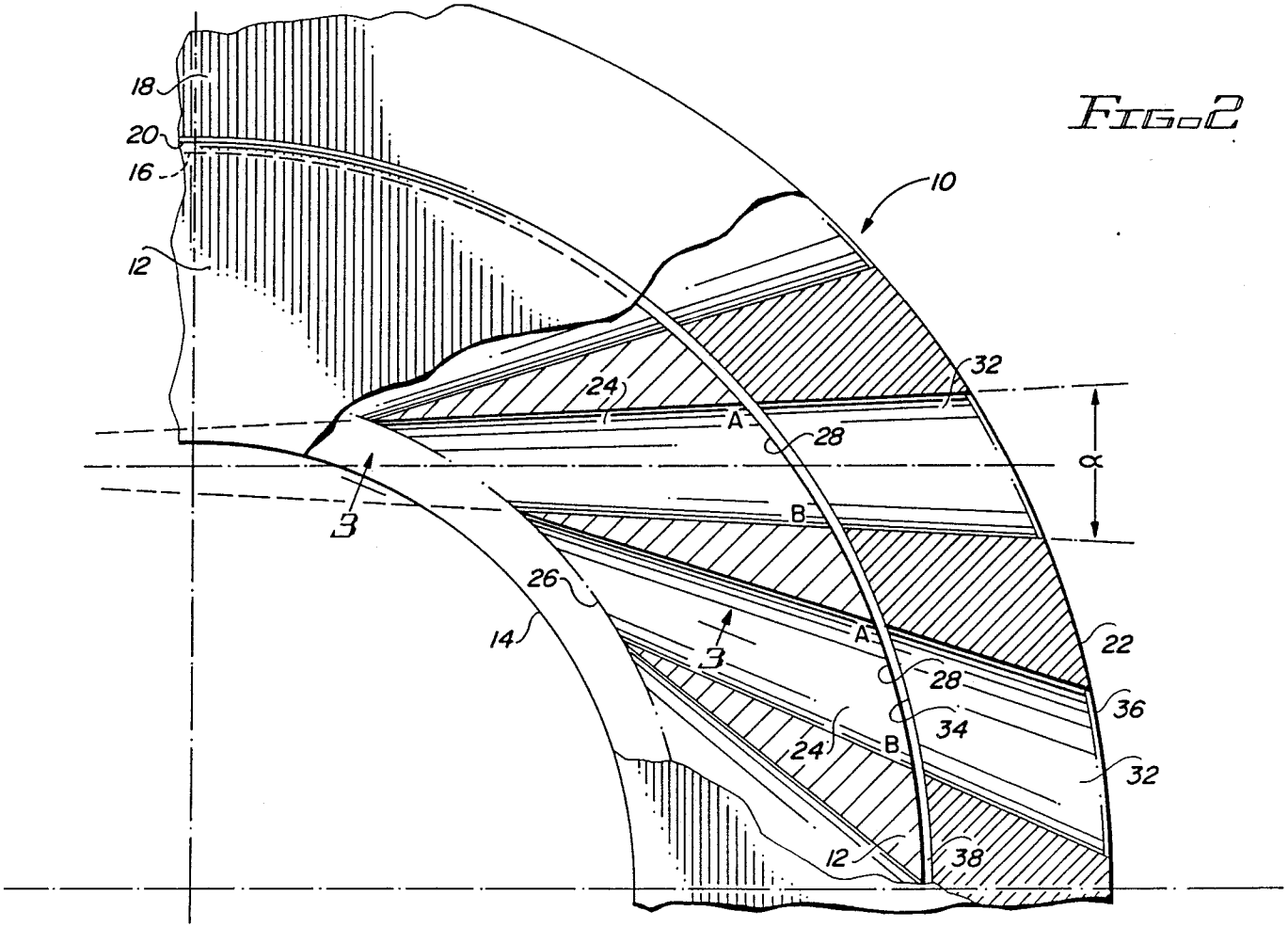
FIG. 2 is an enlarged fragmentary plan view of the diffuser of FIG. 1, with portions broken away to show the interior flow passages.

A first set of flow passages 24 extends radially through the first annular member 12, as can be seen in FIG. 2. Each of the flow passages 24 has an inlet opening 26 near the inner circumference 14 of the member 12 for fluid communication with the impeller and an outlet opening 28 along the outer circumference 16 of the member 12. The diameter, angle and number of the passages 24 are selected such that they mutually intersect near the inner circumference 14 of the first annular member 12, to form a plurality of overlapping elliptical ridges 30 (as shown in FIG. 3) constituting a scalloped leading edge. The exact design of the passages 24 may be varied as necessary to optimize the angle of incidence of the gas and diffusion rate for particular operating conditions.

A second set of flow passages 32 extends radially through the second annular member 18. Each of the flow passages 32 has an inlet opening 34 aligned with the outlet opening 28 of a corresponding one of the flow passages 24 through the first annular member 12, and an outlet opening 36 along the outer circumference 22 of the second annular member 18. The cross-sectional area of each inlet opening 34 is substantially equal to the cross-sectional area of the aligned outlet opening 28 of the corresponding passage 24 through the first annular member 12.

The cross-sectional area of each of the passages 24, 32 through the rings 12 and 18, respectively, increases at a predetermined rate, from a minimum at the inlet 26 of the first annular ring 12 to a maximum at the outlet 36 of the second annular ring. Thus, it can be said that the passages 24, 32 are generally conical, each defining a solid angle $\alpha$. For typical applications, $\alpha$ will be in the neighborhood of 6°. It is not necessary, however, that the cross-sectional area of the passages be circular, as any practical shape which satisfies aerodynamic requirements can be used.

A groove or annular opening 38 is formed along the outer circumference 16 of the first annular member 12. The groove 38 intersects the radially extending passages 24 to allow gas flow in a circumferential direction between the two annular members 12, 18. Alternatively, the groove 38 may be formed along the inner circumference 34 of the second annular member 18. In either case, the groove 38 is preferably located at about the axial mid-point of the diffuser 10.

Coriolis forces on the gas flow through each of the passages 24, 32 will cause a cross-stream pressure gradient to develop in each of the passages 24, 32. Thus, in FIG. 2, the pressure at any point A on one side of a passage will be lower than the pressure at point B at the same radial location but opposite side of the passage. Accordingly, the side containing point A is called the suction side of the passage, while the side containing point B is called the pressure side.

A boundary layer consisting of low momentum fluid will develop in each of the flow paths through the diffuser, as a result of friction at the passage walls. In conventional diffusers, it has been observed that most of the boundary layer accumulates on the pressure side of a flow path, thus blocking the path and leading to diffuser stall. In the instant invention, however, the groove 38 will allow fluid to migrate from the pressure side of one passage 24 to the suction side of the neighboring passage 24. This causes the boundary layer and its resulting blockage to be sucked away, and increases the momentum of the fluid entering the second annular member 18. As a result, the overall diffusion levels of the diffuser 10 are higher, stall characteristics are improved, and the operating range of the diffuser 10 is expanded.

Figure 4:
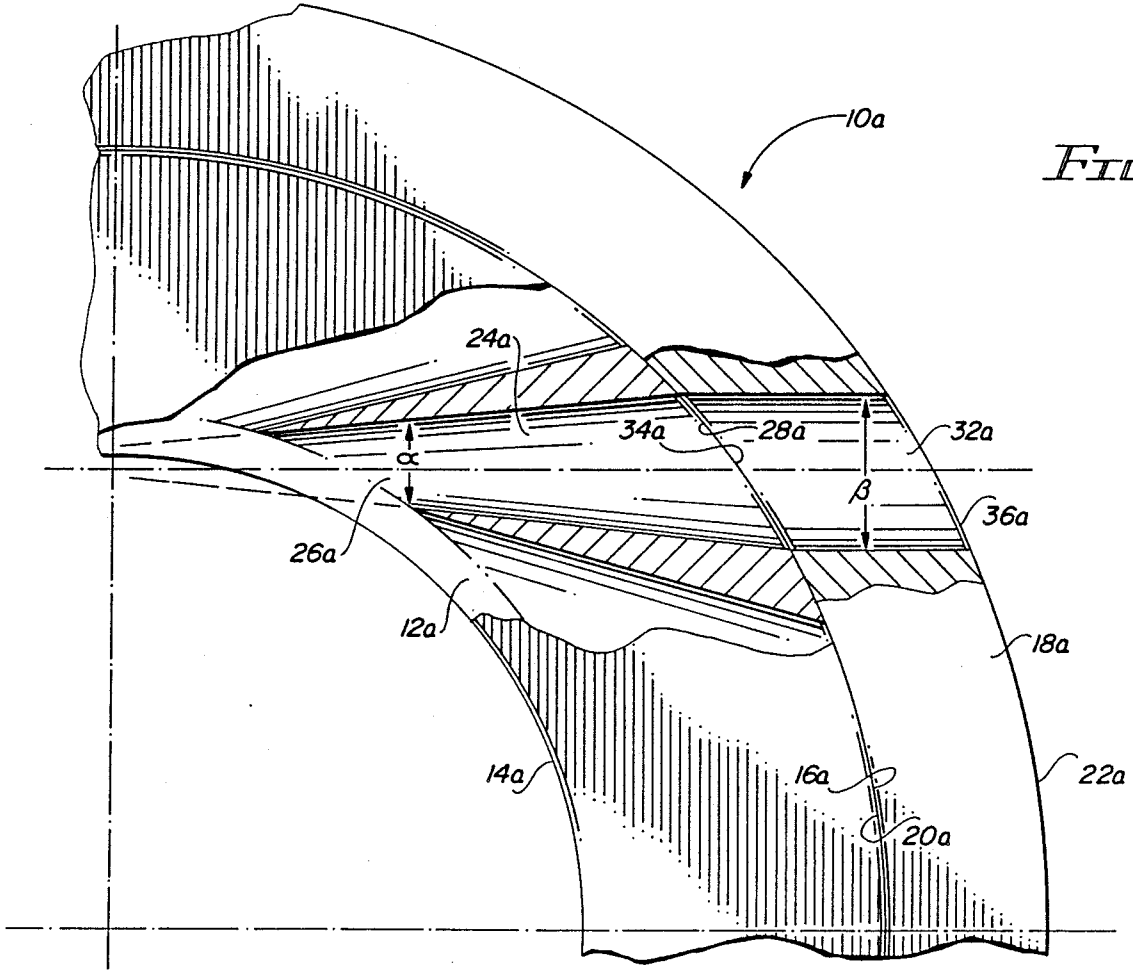
FIG. 4 is a view, similar to FIG. 2, of a second embodiment of the invention.

In a second embodiment of the invention, illustrated in FIG. 4, the diffuser 10*a* again comprises a first annular member 12*a*, having an inner circumference 14*a* for closely surrounding the impeller of a centrifugal compressor and an outer circumference 16*a*, and a second annular member 18*a* having an inner circumference 20*a* for closely surrounding the first annular member 12*a* and an outer circumference 22*a*.

As in the first embodiment, the diffuser 10*a* includes a first set of flow passages 24*a* extending radially through the first annular member 12*a*. Each of the flow passages 24*a* has an inlet opening 26*a* near the inner circumference 14*a* of the member 12*a* for fluid communication with the impeller, and an outlet opening 28*a* along the outer circumference 16*a* of the member 12*a*. The passages 24*a* intersect near the inner circumference 14*a* of the first annular member 12*a* to form a scalloped leading edge.

A second set of flow passages 32*a* extends radially through the second annular member 18*a*. Each of the flow passages 32*a* has an inlet opening 34*a* aligned with the outlet opening 28*a* of a corresponding one of the flow passages 24*a* through the first annular member 12*a*, and an outlet opening 36*a* along the outer circumference 22*a* of the second annular member 18*a*. The cross-sectional area of each inlet opening 34*a* is approximately equal to the cross-sectional area of the aligned outlet opening 28*a* of the corresponding passage 24*a* through the first annular member 12*a*.

However, unlike the first embodiment, in which the cross-sectional area of each passage 32 through the second annular member 18 increases at the same rate as the cross-sectional area of the passages 24 through the first annular member 12, the outer passages 32*a* in the second embodiment diverge at a less rapid rate than the corresponding inner passages 24*a*. In other words, if each of the generally conical inner passages 24*a* describes a solid angle $\alpha$, then each of the outer passage 32*a* describes a solid angle $\beta$, where $0 \leqq \beta < \alpha$. This easily machined "double cone" configuration closely approximates the performance of the well-known "temple-bell" shaped, or optimum, diffuser wherein a condition of incipient boundary layer separation is maintained at all points along the flow path. Thus, the diffuser is able to achieve higher diffusion levels than a straight cone diffuser of equal length.

For the sake of simplicity, the diffuser 10*a* in FIG. 4 has been illustrated without the circumferential groove 38 of the first embodiment. However, it will be obvious to the skilled practitioner that the features of the first and second embodiments can be combined to produce a diffuser having both a groove for boundary layer control and passages formed in a double-cone configuration for producing maximum pressure recovery. The relative advantages and disadvantages of these features will vary depending on the designer's objectives and the operating conditions which the diffuser is expected to encounter.

Various modifications and variations to the embodiments herein chosen for purposes of illustration will readily occur to those skilled in the art. To the extent that such variations and modifications do not depart from the spirit of the invention, they are intended to be included within the scope thereof which is assessed only by a fair interpretation of the following claims.

Having fully described and disclosed the instant invention and alternately preferred embodiments thereof in such clear and concise terms as to enable those skilled in the art to understand and practice the same, the invention claimed is:

1. A diffuser for use with a centrifugal compressor having a rotary impeller, said diffuser comprising:

(a) a first annular member having an inner circumference for closely surrounding the impeller, and an outer circumference opposite said inner circumference;

(b) a plurality of intersecting flow passages extending radially through said first annular member, each of said passages having an inlet opening for fluid communication with the impeller and an outlet opening along the outer circumference of said first annular member, wherein the cross-sectional area of each of said passages increases at a predetermined rate, from a minimum at said inlet opening to a maximum at said outlet opening;

(c) a second annular member having an inner circumference for closely surrounding the outer circumference of said first annular member, and an outer circumference opposite said inner circumference;

(d) a plurality of flow passages extending radially through said second annular member, each of said passages having an inlet opening aligned with an outlet opening in one of the passages through said first annular member and an outlet opening along the outer circumference of said second annular member, wherein the cross-sectional area of each of said passages increases at a predetermined rate from a minimum at said inlet opening to a maximum at said outlet opening, the cross-sectional area of said inlet opening being substantially equal to the cross-sectional area of the aligned outlet opening of said first annular member; and (e) a circumferentially extending groove formed between said first annular member and said second annular member, said groove intersecting said radially extending passages to allow flow between adjacent passages and thus reduce blockage due to boundary layer build-up in the passages.

2. The diffuser of claim 1, wherein the rate of increase of the cross-sectional area of said passages in said first annular member is equal to the rate of increase of the cross-sectional area of said passages in said second annular member.

3. A diffuser for use with a centrifugal compressor having a rotary impeller, said diffuser comprising:

(a) a first annular member having an inner circumference for closely surrounding the impeller, and an outer circumference opposite said inner circumference;

(b) a plurality of intersecting flow passages extending radially through said first annular member, each of said passages having an inlet opening for fluid communication with the impeller and an outlet opening along the outer circumference of said first annular member, wherein the cross-sectional area of each of said passages increases at a predetermined rate, from a minimum at said inlet opening to a maximum at said outlet opening;

(c) a second annular member having an inner circumference for closely surrounding the outer circumference of said first annular member, and an outer circumference opposite said inner circumference; and (d) a plurality of flow passages extending radially through said second annular member, each of said passages having an inlet opening aligned with an outlet opening in one of the passages through said first annular member and an outlet opening along the outer circumference of said second annular member, wherein the cross-sectional area of each of said passages increases at a predetermined rate from a minimum at said inlet opening to a maximum at said outlet opening, the cross-sectional area of said inlet opening being substantially equal to the cross-sectional area of the aligned outlet opening of said first annular member, and wherein the rate of increase of the cross-sectional area of said passages in said first annular member is greater than the rate of increase of the cross-sectional area of said passages in said second annular member.

4. A diffuser for use with a centrifugal compressor having a rotary impeller, said diffuser comprising:

(a) a first annular member having an inner circumference for closely surrounding the impeller, and an outer circumference opposite said inner circumference;

(b) a plurality of generally conical intersecting flow passages extending radially through said first annular member, each of said passages describing a solid angle $\alpha$ and having an inlet opening for fluid communication with the impeller and an outlet opening along the outer circumference of said first annular member;

(c) a second annular member having an inner circumference for closely surrounding the outer circumference of said first annular member, and an outer circumference opposite said inner circumference; and (d) a plurality of generally cylindrical flow passages extending radially through said second annular member, each of said passages describing a solid angle $\beta$ where $0 \leqq \beta < \alpha$ and having an inlet opening aligned with an outlet opening in one of the passages through said first annular member and an outlet opening along the outer circumference of said second annular member, the cross-sectional area of said inlet opening being substantially equal to the cross-sectional area of the aligned outlet opening of said first annular member.

* * * * *